United States Patent [19]

Watkins

[11] 4,254,829

[45] Mar. 10, 1981

[54] WELL LOCKING DEVICE

[75] Inventor: Fred E. Watkins, Houston, Tex.

[73] Assignee: Camco, Incorporated, Houston, Tex.

[21] Appl. No.: 78,112

[22] Filed: Sep. 24, 1979

[51] Int. Cl.[3] ..... E21B 23/02

[52] U.S. Cl. ..... 166/134; 166/214; 166/217; 285/140

[58] Field of Search ..... 166/206, 134, 208, 136, 166/214, 138, 315, 125; 285/140, 315

[56] References Cited

U.S. PATENT DOCUMENTS

| | | | |
|---|---|---|---|
| 2,920,704 | 1/1960 | Fredd | 166/206 |
| 3,090,438 | 5/1963 | Raulins | 166/208 |
| 4,051,896 | 10/1977 | Amancharla et al. | 166/208 |
| 4,161,984 | 7/1979 | Watkins | 166/315 |

*Primary Examiner*—James A. Leppink

*Attorney, Agent, or Firm*—Fulbright & Jaworski

[57] ABSTRACT

In a well lock and a locking nipple for use in a tubing in a well in which the locking nipple includes first and second recesses and a stop shoulder and the well lock includes a locking housing carrying first and second locking dogs, seal means on the exterior of the housing for sealing with the nipple, a resiliently outwardly urged locator having a shoulder for engaging the stop shoulder, a mandrel telescopically positioned in the housing, a locking shoulder on the mandrel locking the first locking dogs in the first recess and means on the mandrel engaging the second locking means for preventing unlocking of the first locking dogs if pressure is applied to the seal to move the housing upwardly, the improvement in which the distance between the bottom of the first recess and the locking shoulder is greater than the distance between the bottom of the first locking dogs and the locator shoulder whereby the first locking dogs lock the device against upwardly and downwardly forces and the locator is retracted out of contact with the stop shoulder.

4 Claims, 4 Drawing Figures

WELL LOCKING DEVICE

BACKGROUND OF THE INVENTION

U.S. Pat. No. 4,161,984 discloses a locking device that is used to support equipment in the production string of an oil and/or gas well which is particularly suitable for use in a well which may be subject to high pressures either above or below the lock. However, that lock utilizes a locator key which is urged outwardly by a spring whereby the locator key may be fully extended when the lock is locked allowing an to accumulate between the inside of the key and the housing causing difficulty in retracting the key and the lock when the lock is being removed.

The improved lock of the present invention insures that locking dogs will positively hold upwardly or downwardly loads on the lock without relying upon the locator keys and the locator keys are held in a retracted position when the lock is set thereby avoiding accumulation of debris behind the locator keys which would prevent their retraction and the removal of the lock.

SUMMARY

The present invention is directed to an improved well lock for locking in the bore of a tubing in a well in which the tubing includes first and second recesses and a stop shoulder. The lock includes first locking means for holding against a load either from below or above the well lock and second locking means are actuated by the existence of high pressure in the tubing below the lock to normally prevent the well lock from being released. Locator means on the housing are resiliently actuated outwardly and have a locating shoulder for engaging the stop shoulder in the tubing. A mandrel is telescopically movable in the housing for actuating the first and second locking means. The distance between the bottom of the first locking means and the locator shoulder is less than the distance between the bottom of the first recess and the stop shoulder on the tubing for insuring that the locator means is retracted inwardly when the first locking means is locked in the first recess.

A still further object of the present invention is the provision of an improved combination of a well lock and locking nipple in which the distance between the bottom of the first recess and the locking shoulder in the locking nipple is greater than the distance between the bottom of the first locking means and the locating means shoulder on the lock whereby when the lock is set the first locking means locks against upwardly and downwardly forces without relying upon the locator key shoulder and also holds the locator key in a retracted position against the lock housing.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
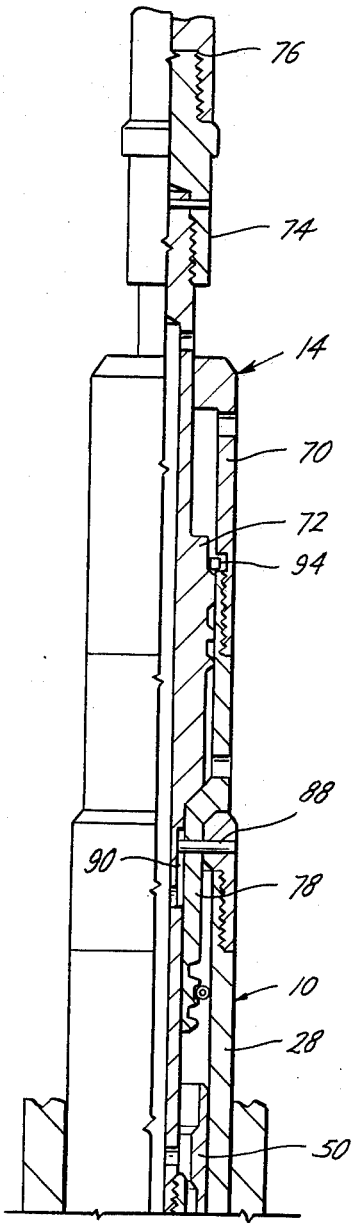
FIGS. 1A and 1B are continuations of each other of an elevational view, partly in cross section, of a well lock of the present invention being run into position in a locking nipple of the present invention.
Figure 1B:
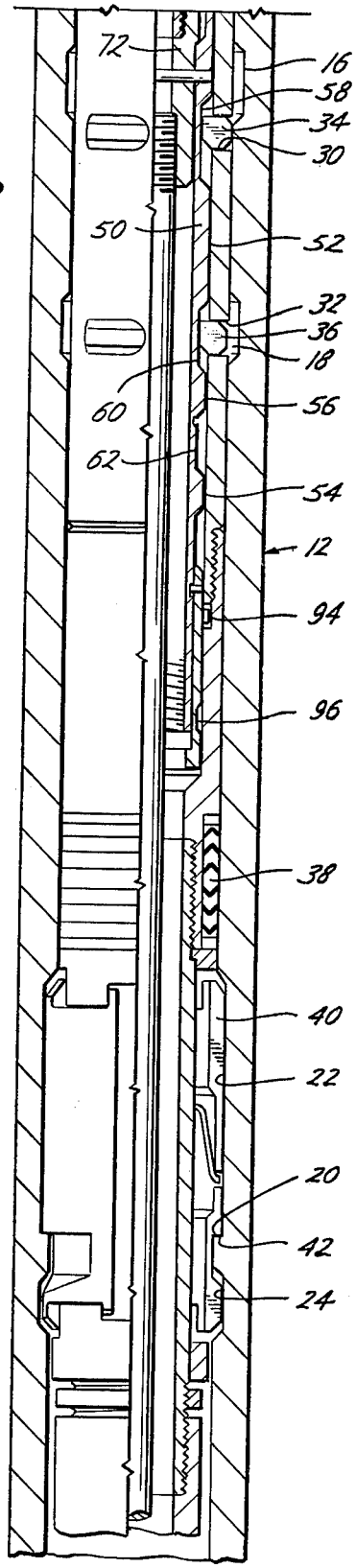

Referring now to the drawings, and particularly to FIGS. 1A and 1B, the reference numeral 10 generally indicates the well lock of the present invention being installed in a well production tubing, such as in a landing or locking nipple generally indicated by the reference numeral 12, by means of a running tool generally indicated by the reference numeral 14 supported from a wireline (not shown) as is conventional.

The locking nipple 12 is positioned in the well tubing in the well bore and includes a first recess 16, a second recess 18 and suitable locating means such as a stop shoulder 20 for suitably positioning the well lock 10 in the nipple 12 and may include selector profile sections 22 and 24.

The well lock 10 generally includes a housing 28 and first openings 30 and second openings 32 for receiving first locking means 34 and second locking means 36, respectively, such as sets of locking dogs. The housing 28 includes a seal means 38 for sealing against the nipple 12. The housing 28 further includes suitable locating or stopping means such as conventional selector keys 40 which are spring loaded outwardly and which have a shoulder 42 for coacting with the stop shoulder 20 of the nipple 12. The keys may have an exterior profile matching the profiles of sections 22 and 24 of the nipple 12 for selectively locating the well lock 10 in a particular nipple 12 as is conventional.

The well tool 10 includes a locking and releasing mandrel 50 positioned for telescoping movement in the housing 28. The mandrel 50 includes a first locking shoulder 52, a second locking shoulder 54, and if desired, a third locking shoulder 56 with suitable grooves therebetween such as groove 58, a second groove 60, and a third groove 62.

The running tool 14 may include a body 70, an actuating member 72 which is movable relative to the body 70 and is connected to a fishing neck 74 and in turn to a wireline connection 76. A first shear pin 88 is provided not only connecting the tool body 70 to the housing 28 of the well lock, but also extending from the body 70 into a groove 90 in the actuating member 72 thereby initially allowing a limit to the amount of upward movement of the actuating member 72 relative to the body 70. A second shear pin 92 is connected between the mandrel 50 and the actuating member 72 whereby the actuating member 72 may move the mandrel 50. In addition, a collet ring 94 initially holds the actuating member 72 downwardly relative to the body 70 of the setting tool 14 which in turn holds the mandrel 50 in the position shown in FIG. 1B with the locking dogs retracted in the grooves 58 and 60, respectively.

As best seen in FIGS. 1A and 1B, the well lock 10 is lowered by the running tool 14 from a wireline through a well tubing in a well until the locator means such as the selector keys 40 having a shoulder 42 engage the stop shoulder 20 in the nipple 12 thereby positioning the lock 10 in a nipple 12 for setting. The foregoing description and operation of the lock 10 is generally disclosed in Patent No. 4,161,984 and is incorporated herein by reference.

Figure 2A:
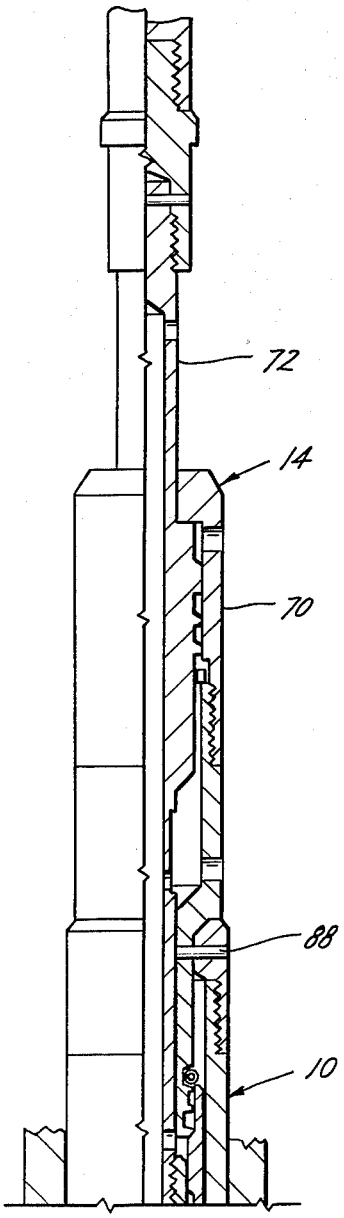
FIGS. 2A and 2B are continuations of each other of an elevational view, partly in cross section, of the apparatus of FIGS. 1A and 1B, but shown in the set position.
Figure 2B:
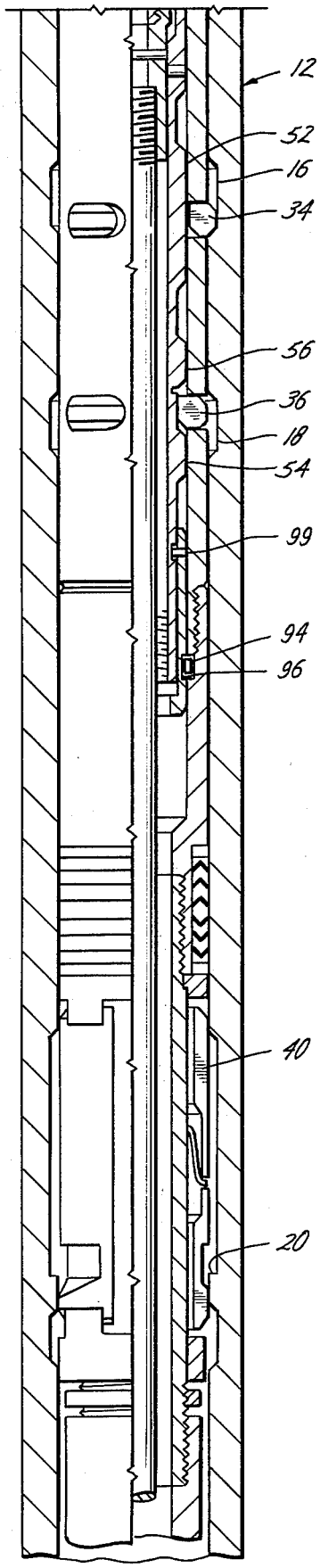

In setting the lock 10, the housing 28 is initially held in the nipple 12 as the setting tool actuator 72 moves upwardly relative to the body 70 overcoming the spring collet 94 allowing the groove 90 to move past the shear pin 88, and carrying the mandrel 50 upwardly relative to the housing 28 to initially move shoulder 56 behind the locking dogs 36 to drive the dogs 36 outwardly into the recess 18. Further upward movement of the actuator 72 shears the portion of the shear pin 88 in the groove 90 thereby carrying the mandrel 50, as best seen in FIGS. 2A and 2B, upwardly to move the shoulder 56 past the lower locking dogs 36 and bring the lower locking dogs 36 into groove 62 and against the top of shoulder 54 thereby carrying the housing 28 upwardly. Shoulder 52 then moves behind locking dogs 34 to move the dogs 34 into a locked position in the recess 16 at which time the shear pin 92 between the actuator 72 and the mandrel 50 shears. It is to be particularly noted that upward movement of the housing 28 moves the lower keys 40 upwardly and away from the stop shoulder 20 and causes the keys 40 to contact the inside of the nipple 12 and move to a retracted position. It is an important feature of the present invention that the locator keys 40 not be left in the expanded position as well locks may frequently be left in nipples 12 for several years thereby allowing the buildup of debris such as sand behind the locator keys thereby preventing the keys 40 from thereafter being retracted out of profiles 22 and 24 and preventing release of the well lock 10 from the nipple 12. To insure that the locator keys 40 are retracted inwardly when the locking dogs 34 are set, the distance between the bottom of the first recess 34 and the locking shoulder 20 is made greater than the distance between the bottom of the locking dogs 34 and the shoulder 42 on the locator keys 40.

The well lock 10 is properly locked in position as shown in FIGS. 2A and 2B. That is, the mandrel 50 is locked to the housing by a C-ring 94 in the housing which engages a groove 96 in the hold-down sleeve 98 which in turn is connected to the mandrel 50 by a shear pin 99. The shoulder 52 remains behind the dogs 34 keeping them locked in the recess 16 against loads supplied in either an up or downward direction. Furthermore, the lock dogs 34 entirely support the load of the lock 10 and do not rely upon the locator keys 50 carrying any load through the shoulder 20.

The vertical spacing between the locking dogs 34 and 36 is less than the vertical distance between the tops of the first and second recesses 16 and 18 and the nipple 12 whereby a load, such as downhole pressure on the seal 38, causes upward movement of the lock 10 and the dogs 36 move out of their recess 18 and into the groove 62 causing the mandrel shoulder 54 to come into engagement with the lower side of the dogs 36 to prevent upward movement of the mandrel 50. After the lock 10 is set in the nipple 12, an upward jar is taken to jar the actuator 72 against the body 70 of the running tool to shear the pin 88 thereby releasing the running tool 14.

The present improved tool 10 can be removed from the nipple 12 as previously described in U.S. Pat. No. 4,161,984. That is, a pulling tool is provided for connection to the mandrel 50 which jars the mandrel 50 downwardly but shears the pin 99 and the locking dogs 34 and 36 are aligned with the recesses 16 and 18. In the event that downhole pressure is not sufficient to return the lock 10 to the locked position an upward pull is taken which pulls the mandrel 50 and shoulder 54 on the mandrel 50 forces the dogs 36 into the recess thereby freeing the mandrel 50 for upward movement. Further upward movement of the mandrel 50 until its upper end stops against the internal shoulder 89 of the housing 28 positions all the shoulders on the mandrel 50 out of contact with a locking dogs 34 and 36 allowing them to be retracted into the grooves such as 60 and 63 and further upward movement retrives the well lock 10 from the landing nipple 10.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. In a well lock for locking in the bore of a tubing in a well, said tubing including first and second recesses and a stop shoulder, said lock including a lock housing carrying first and second locking means, seal means positioned on the exterior of the housing and adapted to seal with the bore of the tubing, locator means on the housing having a shoulder for engaging said stop shoulder, a mandrel positioned for telescoping movement in the housing, means on the mandrel for locking the first locking means in the first recess on longitudinal movement of the mandrel, means on the mandrel for engaging said second locking means for preventing unlocking of the first locking means if pressure is applied to the seal to move the housing upwardly, and releasable locking means between the mandrel and the housing, the improvement comprising, the distance between the bottom of the first locking means and the locator shoulder being less than the distance between the bottom of the first recess and the stop shoulder on the tubing.

2. The apparatus of claim 1 wherein said locator means is normally biased outwardly for engaging said locator shoulder with said stop shoulder, but said locator means is retracted and out of contact with said stop shoulder when the first locking means is locked into the first recess by said mandrel.

3. In the combination of a well lock and a locking nipple for use in a tubing in a well, said locking nipple including first and second recesses and a stop shoulder, said well lock including a lock housing carrying first and second locking means, the vertical spacing of the first and second means being less than the vertical distance between the tops of the first and second recesses, seal means positioned on the exterior of the housing and adapted to seal within the locking nipple, outwardly urged locating means having a shoulder for engaging the stop shoulder of the nippple, a mandrel positioned for telescoping movement in the housing, means on the mandrel for locking the first locking means in the first recess on longitudinal movement of the mandrel, and means on the mandrel for engaging said seond locking means for preventing unlocking of the first locking means if pressure is applied to the seal to move the housing upwardly forcing the second locking means out of the second recess and toward the mandrel, the improvement comprising, the distance between the bottom of the first recess and the locking shoulder being greater than the distance between the bottom of the first locking means and the locating means shoulder whereby when the lock is set the first locking means locks the lock against upwardly and downwardly forces.

4. The apparatus of claim 3 wherein said locator means is normally biased outwardly for engaging said locator shoulder with said stop shoulder, but said locator means is retracted and out of contact with said stop shoulder when the first locking means is locked into the first recess by said mandrel.

* * * * *